US006760924B2

(12) United States Patent
Hatch et al.

(10) Patent No.: US 6,760,924 B2
(45) Date of Patent: Jul. 13, 2004

(54) GLOVE

(75) Inventors: William Hatch, Ojai, CA (US); Michael W. McCarey, Crestline, CA (US)

(73) Assignee: Hatch Imports, Inc., Oxnard, CA (US)

( * ) Notice: Subject to any disclaimer, the term of this patent is extended or adjusted under 35 U.S.C. 154(b) by 47 days.

(21) Appl. No.: 10/152,580

(22) Filed: May 23, 2002

(65) Prior Publication Data

US 2002/0174477 A1 Nov. 28, 2002

Related U.S. Application Data

(60) Provisional application No. 60/292,525, filed on May 23, 2001.

(51) Int. Cl.[7] ..... A41D 19/00
(52) U.S. Cl. ..... 2/161.5; 2/163
(58) Field of Search ..... 2/160, 163, 161.1–161.6, 2/161.8, 164

(56) References Cited

U.S. PATENT DOCUMENTS 474,929 A * 5/1892 Tabor et al. ..... 2/163
4,094,014 A * 6/1978 Schroeder ..... 2/161.8
4,704,743 A * 11/1987 Thornell et al. ..... 2/161.1
4,881,276 A * 11/1989 Swan ..... 2/161.1
5,113,532 A * 5/1992 Sutton ..... 2/167
5,187,815 A * 2/1993 Stern et al. ..... 2/16
5,228,142 A * 7/1993 Yoswein-McGreen ..... 2/169
5,697,104 A * 12/1997 Welton ..... 2/159
5,745,919 A * 5/1998 Kraatz ..... 2/161.6

* cited by examiner

*Primary Examiner*—Katherine Moran
(74) *Attorney, Agent, or Firm*—Lowe Hauptman Gilman & Berner, LLP

(57) ABSTRACT

A glove, that is adapted to be used on at least the shooting hand of a shooter of a fire arm, made up of a main body portion, that closely approximates the size and shape of a hand; a gauntlet that extends from the main body portion and is adapted to cover at least a portion of the fore arm of the glove wearer, and finger elements that extend from the main body portion in a direction opposite to the direction of the gauntlet. The trigger finger element has a cut ring disposed between the palm directed end of the trigger finger element and a distal end of the same trigger finger element. The cut ring is made up of cross stitch members that are disposed within the fabric portion of the finger element.

20 Claims, 4 Drawing Sheets

GLOVE

This application is a continuation in part of provisional patent application 60/292,525 filed May 23, 2001.

This invention relates to a glove. It more particularly refers to a glove that is specifically designed for use by a shooter, that is a person who will use the glove as an adjunct to handling and firing of a firearm, such as for example a hand gun, a rifle or a shotgun. It is also related to the handling of other equipment, such as offensive or defensive equipment, such as: munitions, targeting devices, radio equipment, and the like. Especially such equipment as is used by armed forces or law enforcement personnel

BACKGROUND AND PRIOR ART

Professional shooters, such as for example members of SWAT teams and military personnel, often wear gloves as part of the equipment associated with the firearm that they are called upon to handle. It is common for such gloves to be made of an antiballistic material in order to offer protection to the shooter's hand(s) while they are exposed. It is also common for the shooter to modify a newly acquired glove by removing a portion of the glove's trigger finger. This enables the shooter to have a better "feel" for the pull of the trigger and therefore the shot can be more accurate. While the removal of the distal portion of the glove's trigger finger may be important to insure a good trigger feel, it is also disadvantageous in that the removal of this portion of the glove's trigger finger is often accomplished by the shooter simply cutting off the distal end of the finger portion of the glove with a knife or scissors. This action cuts the threads of the woven or knitted material from which the glove has been made, and it will likely cause the fabric of the remainder of the glove/finger body to unravel. In a very short time, the glove fabric unravels sufficiently so that at least the trigger finger, and possibly the whole glove, becomes relatively useless.

It is also common for professional shooters to use shooting gloves made of materials that are flame and powder flash resistant. Gloves made of these same materials are often worn by aviators as well. One specific material that has been used for making shooter's gloves is NOMEX. This material has excellent fire resistance, but is less resistant to penetration by a knife or other cutting threat than would be desirable. NOMEX is less resistant to being cut by flying glass or metal particles than is desirable.

It has been usual for conventional shooter's gloves to fit with about the same snugness and in the same manner as conventional gloves that are used to protect the hands against cold. That is, they are made to somewhat loosely fit the hand of the wearer. This loose fit can cause slip between the weapon and the hand of the shooter. Such slippage can detract from the accuracy of a shot.

Loose fitting of a glove is advantageous where warmth is the reason for wearing the glove. However, it can be a disadvantage where the glove covers the hand of a shooter whose accuracy of shot is of paramount importance. The extra material that is used to make a glove body fit loosely, and to thereby increase its warmth retention characteristics, can be an obstruction to accuracy in the case of a shooting glove. It is well known that shooting gloves should have as snug a fit as possible, suitably a skin tight fit.

OBJECTS AND BROAD STATEMENT OF THE INVENTION

It is an object of this invention to provide a novel shooter's glove.

It is another object of this invention to provide a shooter's glove that has less slip between the glove and the weapon.

It is a further object of this invention to provide a glove that has adequate resistant to powder burn and increased resistance to cutting, as by a knife, glass or the like.

It is a still further object of this invention to provide a shooter's glove in which the distal portion of the trigger finger is removable at the option of the wearer without the disadvantage of the glove unraveling.

Other and additional objects of this invention will become apparent from a consideration of this entire specification including the drawing that is an integral part thereof.

In accord with and fulfilling these objects, one aspect of the instant invention lies in a novel glove construction that is particularly well suited to use by professional shooters, such as a SWAT team member or a member of a police force or the military.

The novel glove construction of this invention comprises a body portion that is commensurate in size and shape of, and is intended to cover, at least the palm portion of a human hand. The glove may also be tailored to cover the back of the shooting hand and/or it may cover some or all of the shooters' fingers other than the trigger finger. The glove may be left or right handed depending on the specific shooter that it is made for. A most preferred aspect of this invention, each glove is tailored to the specific hand that it is intended to cover so that a snug fit is ensured. One adjunct aspect of this invention provides that the glove is insulated without departing from the snug fit provision.

The body portion of the instant glove suitably has attached to its proximal end a gauntlet that is of a size and shape that can cover at least a portion of the forearm of the wearer. At or near the attachment of the gauntlet to the body portion, there is provided circumferential elastic means that serves to hold the proximal portion of the body portion of the glove relatively tightly about the wrist of the wearer. In some cases, the gauntlet portion is integral with the body portion. In some cases, the elastic portion is built into the structure of the glove/gauntlet. In some situations, these two elements, the glove and the gauntlet, can be separately constructed and then joined together to construct the total glove/gauntlet assembly. The purpose of the circumferential elastic wrist band is to pull the glove body toward the wearer's wrist so as to enforce a snug fit about the trigger finger and the palm. If the back of the hand and/or other fingers are covered by the glove, they too will be pulled tight toward the forearm by the elastic band about the wrist area. Thus this structure maintains the glove in a snug fit and in close proximity to the covered portions of the hand at all times. The glove does not tend to slip away from the wrist and off the fingertips.

In a preferred embodiment of this invention, the gauntlet is terminated, at its proximal end, with an additional circumferential elastic means sufficiently sized, and with enough elasticity, to hold the gauntlet against the wearer's forearm, preferably over the forearm muscle at or near the elbow. This forearm circumferential elastic band substantially isolates the wearer's hand and forearm from the intrusion of foreign objects between the glove and the hand and therefore prevents foreign objects from coming into proximity with the wearer's skin. Of particular importance in this regard is the exclusion of the bullet casings and/or broken glass of other frangible objects that could cause cutting of the shooter's skin or other damage.

Except for the circumferential elastic bands about the proximal end of the gauntlet, and at or near the juncture of the gauntlet and the glove body, the gauntlet can be either tight fitting or loosely draped about the wearer's forearm. In an embodiment of this invention, the material from which the gauntlet is made is preferably an antiballistic material. Literally dozens of antiballistic materials are available in woven or knitted form and are quite suitable for use in making the glove of this invention. In a most preferred embodiment, the gauntlet, and other elements of the glove of this invention, are made from a woven or knitted (especially knitted) fabric that comprises high tenacity aramide fibers/filaments, such as the material sold commercially under the trademark KEVLAR®. Other antiballistic filamentary material, such as poly(1,4-phenylene-2,6-benzbisoxazole), sometimes referred to as PBO and sold under the trademark ZYLON®, in yarn or monofilament form is also appropriate for this use.

Yarn is preferred because of its softer and more comfortable feel, but monofilament is stronger for the same denier. The fabric of the glove of this invention can be made of exclusively antiballistic yarns or it can be made of yarns that are made up partially of antiballistic fibers and partially of other fibers/filaments. Specifically, known elastic yarns or monofilaments can be admixed with antiballistic fibrous materials in order to make the glove of this invention conform even more closely to the wearer's hand. In this respect, elastic or other yarns can be selectively located where they will be most effective in conforming the glove to the wearer's hand.

Suitably sized and shaped finger and thumb elements are attached to the distal end of the glove body. These too are made so as to provide a snug fit. One important aspect of this invention is the provision of a cut line located between the fingertip end of the trigger finger element and the glove body. Suitably, this cut line may circumscribe the entire index finger glove element, or it may be made up of plural displaced cut lines that collectively circumscribe the index finger. It is important that the portion of the trigger finger element that is made of knitted fabric have a cut line in it to permit the shooter to free at least the first digit of the trigger finger. Where the trigger finger element is made of a composite material, such as for example knitted material on the backside and leather or plastic high friction material on the palm side of the finger element, it is only absolutely required that the knitted fabric portion of the index finger element have a cut line built into it, although it is considered to be within the scope of this invention to provide a cut line about all of the composite materials. The material other than the knitted material will not unravel even if it is directly cut without the benefit of a cut line and therefore, a place need not be specifically provided for supporting cutting of this element. The cut line is preferably located about half way between the fingertip portion of the trigger finger glove element and the glove body. The exact location can be moved toward or away from the fingertip portion of the finger glove element to suit the wearer's preferences. Plural spaced apart cut lines can be provided so that the shooter has the option of removing as much or as little of the trigger finger covering as is preferred. The cut line is preferably made of cross stitching. The cut line serves to separated the eave of the distal portion of the finger element from the weave of the proximal portion of the finger element. Thus, if the finger element is cut through the cut line, that is preferably through the cross stitching, or distal from the cut line, the weave of the finger element will not unravel past the cut line.

The cut line is so constructed that the finger element(s) of the glove, preferably, but not exclusively the trigger finger element, can be transversely cut through at the cut line without causing the rest of the fabric of the index finger glove element to unravel. It is considered to be within the scope of this invention for there to be more than one finger element that contains the invented cut line. This embodiment envisions a full fingered glove being convertible to a half fingered glove at the option of the wearer. Where the cut line is disposed on the trigger finger, suitably the shooter's index finger, the distal end of the trigger finger can be partially exposed sufficient to enable to shooter to have excellent contact between the trigger finger and the trigger with no opportunity for the remainder of the finger element fabric to unravel.

An important preferred element of this invention lies in the fact that the palm side of the glove body, and preferably the palm side directed portions of the finger elements as well, is made up of at least partially of a layer of a substantially non-slip, high friction material. This material may make up the entirety of the glove body and finger elements, or it may constitute all or part of the palm side of the glove body and/or finger element(s), in which case it can be stitched or otherwise attached to the fabric (suitably knitted) that covers the back of the hand and fingers. In the alternative, the glove may be entirely made of fabric, preferably antiballistic knitted fabric, and the high friction material attached to the knitted fabric as an overlaid second layer. In another alternative, the glove of this invention may have portions of the palm side constructed of high friction material and other portions constructed of knitted material, suitably, but not necessarily, anti ballistic fibrous material.

In a preferred embodiment, the palm side of the glove body is made of two layers of material. The skin side layer may be fabric or it preferably is a leather or plastic material that may have a relatively low coefficient of friction so that the glove can be easily put on. The outer layer, that is the layer of material that will become proximate to the firearm, can be made of a high friction material that is applied over the skin side layer and is suitably adhered thereto, such as by stitching or adhesive or the like. The absolute values of the coefficients of friction of these skin side and outer side layers are not critical to the invention. Materials with the required coefficients of friction can be chosen from the wide variety of sheet form materials that are available and will be selected relative to the material from which the gripped part of the fire arm is made and the relative sensitivity of the skin of the wearer.

An important, preferred aspect of this invention is that the outer layer does not completely overlap and coincide with the skin side layer. The outer layer preferably covers less than the whole of the palm portion of the glove body. A first area, that is generally disposed between the thumb glove element and the center of the palm portion of the glove body, is preferably made of only one layer of material, suitably the skin side layer only. There are fewer layers of material in this first area than in the remainder of the palm portion of the glove body. This enables the thumb to be moved inwardly, that is toward the side of the hand, without the palm portion of the glove material bunching up. Alternatively, or in addition, preferably, a second, similar one layer area of the glove body is disposed across the palm area, suitably closer to the finger elements than the first area, but spaced from the first area. High friction, suitably embossed leather material is disposed as one layer of a plurality of layers in the area between these first and the second areas.

Another aspect of this invention lies in the provision of a padded area in the glove body proximate to the heel of the shooter's hand. Suitably, this padded area is proximate to the first one layer area referred to above. In fact, in a most preferred aspect of this invention, the first one layer area wraps around and is proximate to two adjacent sides of the padding; the side that is directed toward the thumb element and the side that is directed toward the finger elements. Thus, when the hand inside the glove is closed into a fist, a portion of the first area, that is generally transverse to the finger elements and is disposed away from the finger elements, as well as the second area, that is proximate to and transverse of the finger elements, tend to collapse and take up the material of the glove body that is folding upon itself as the fist is closed. This insures continued good contact between the shooter's hand and the weapon.

In another preferred aspect of this invention, padding is disposed on the back of the glove body proximate to where the wearer's knuckles will be when the glove is worn. This padding functions to protect the wearer's knuckles from bruising or other injury.

A further aspect of this invention resides in the disposition of highly non-skid material over the glove body portion that is disposed between the thumb and the index finger. This area of the shooter's hand contacts the handle or stock of the weapon and serves to insure that the shooter maintains positive control of the weapon.

BRIEF DESCRIPTION OF THE DRAWING

Understanding of this invention will be facilitated by reference to the accompanying drawing in which.

DETAILED DESCRIPTION OF THE INVENTION

Figure 1:
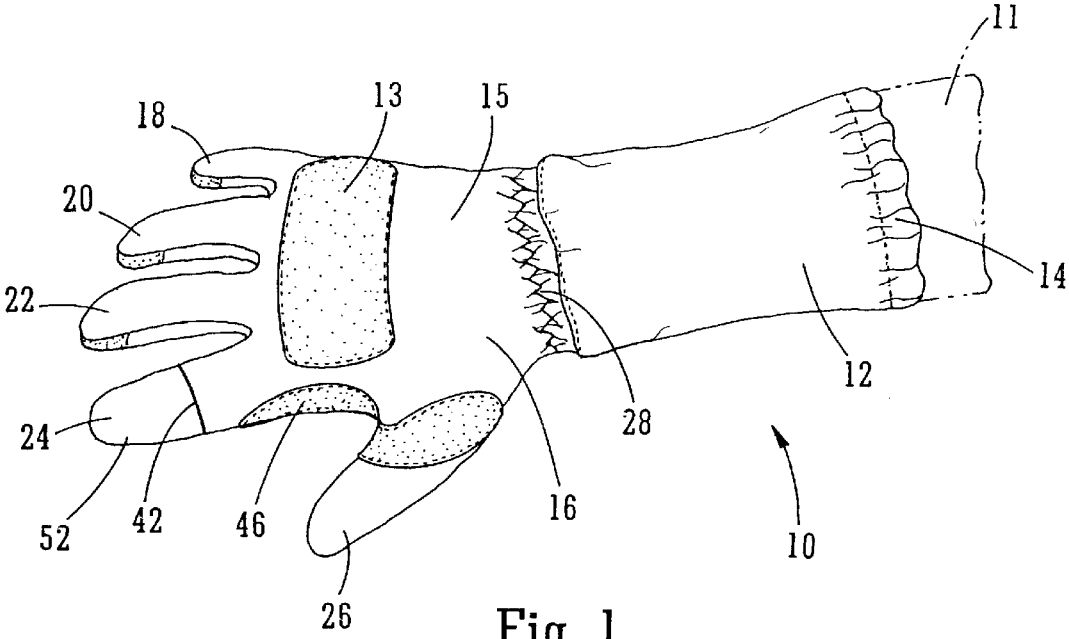
FIG. 1 is a perspective view of a glove according to this invention viewing the back of the glove.
Figure 2:
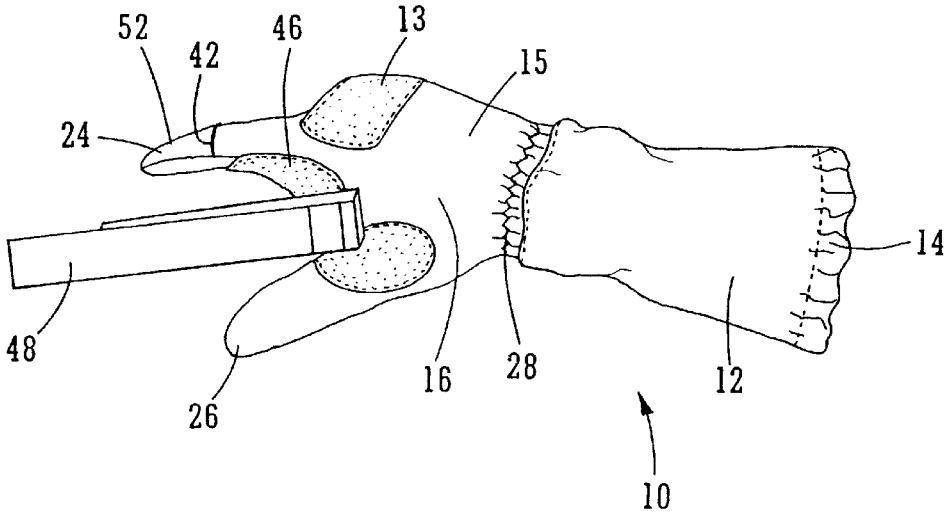
FIG. 2 is a perspective view of a glove according to this invention viewing the side of the glove showing the thumb and index finger.
Figure 3:
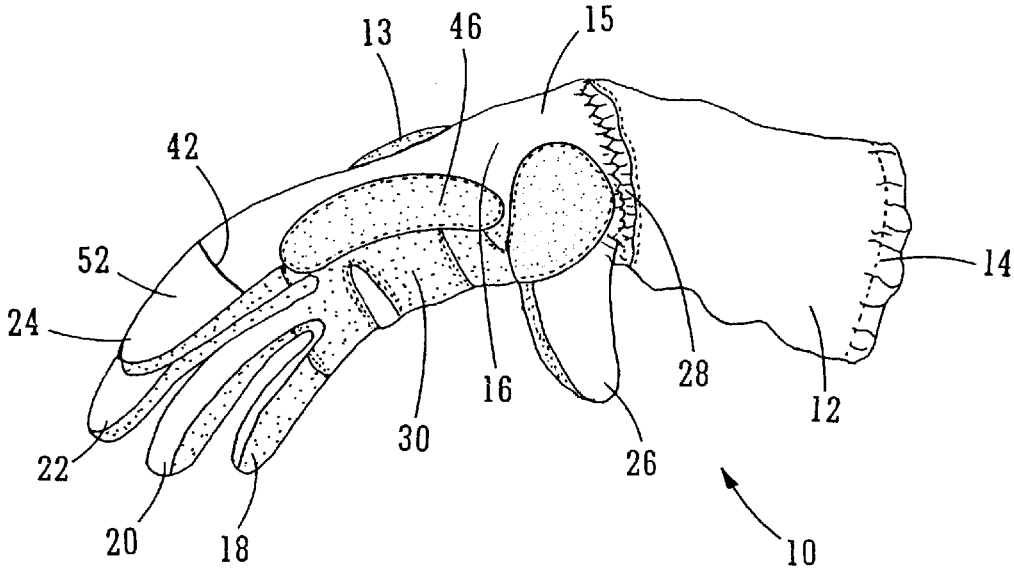
FIG. 3 is a perspective view of a glove according to this invention viewing the side of the glove from a different angle and showing the thumb and index finger as well as a portion of the palm.

Reference will hereafter be made to a description of a preferred aspect of the glove of this invention in relation to the several figures of the drawing. Like parts will be identified with like reference numerals.

A glove 10 of this invention comprises a body portion 16 that is so sized and shaped to fit snugly over the palm and back of the operator's hand (not shown). The body portion 16 has a snugging first elastic member 28 disposed at or very near to its proximal end. A gauntlet 12 is attached to the body portion of the glove at or near the first elastic member 28 and loosely, or snugly, fits about the wrist and forearm 11 of the operator who is wearing the glove 10. The elastic member 28 preferably extends about the entirety of the glove body and is disposed at or near the juncture of the base of the thumb and the gauntlet. A second snugging elastic member 14 is disposed at the end of the gauntlet remote from its area of attachment to the body portion 16, or proximal to the wearer's body. The distal end of the body member 16 has several finger elements 18, 20, 22, and 24 and a thumb element 26 attached thereto and extending outwardly therefrom. When it is being worn, the glove 10 of this invention is intended to be disposed between the operator's hand and a weapon 48.

The body of the glove 10 has several features that are important to this invention but are not critical. A knuckle protecting pad 13 is disposed on the upper or back side of the body portion 16. This pad 13 is suitably adhered to the fabric of the glove that is proximate to the back of the operator's hand. It serves to protect the operator's hand from damage that might be caused by the back of the hand scraping against a wall or a floor surface or the ground, or the like. It is within the scope of this invention to provide an aperture in the glove body that is the shape and size of the knuckle pad 13, to insert the knuckle pad into this space and attach it to the rest of the glove body 16. It is also appropriate to form the entire glove body back portion 15 of a suitable glove material as aforesaid and then attach the knuckle pad onto the outside of the glove material, such as an antiballistic, cut resistant knitted fabric.

The palm side 30 of the body of the glove is also an important feature of the instant glove 10. It is constructed so that when the fingers of the operator are collapsed into a fist like shape, especially when compressed against a weapon, the material in the palm portion 30 does not bunch up and reduce effective operator feeling and control. One manner of accomplishing this is to make the palm portion 30 of the body 16 out of a plurality of layers of material. Portions of the palm portion 30 are constructed of all of the layers and other portions of the palm 30 are constructed of less than all of the layers. In a preferred embodiment of this invention, the main material that covers the entire palm may be a single sheet of leather, plastic or fabric. It is appropriate to use a fabric that has some constricting elasticity in order to maintain a snug fit of the glove body to the operator's palm. In order to provide a good grip on the weapon, the main palm material has at least one second sheet of material 40 overlaid on it. This overlaid material may be leather or plastic that is made of a high friction (with respect to the material from which the weapon has been made) material, or has a high friction embossing on its exposed surface.

The second, overlaid sheet 40 preferably does not completely cover the palm material 30. Rather, it is so cut and shaped that at least one area 34 and/or 36 is left with the palm material 30 exposed and without any second material 40 disposed over the palm material 30. In a most preferred embodiment, an elongated exposed portion 36 is disposed between the main portion of the palm material 30 and the base of the fingers. The length of this elongated first cut out 36 is variable for the comfort of the operator. In the instant drawing (see FIG. 4) this first cut out 34 extends from the vicinity 38 of the base of the pinky finger element 18 to the vicinity 39 of the base of the ring finger element 22.

Optionally, a cushioning pad 32 can be disposed on the main body fabric proximate to the heel of the hand of the operator. This pad too has the purpose of protecting the operator against cuts and scrapes that might cause him to lose concentration and be less accurate with his weapon.

Figure 4:
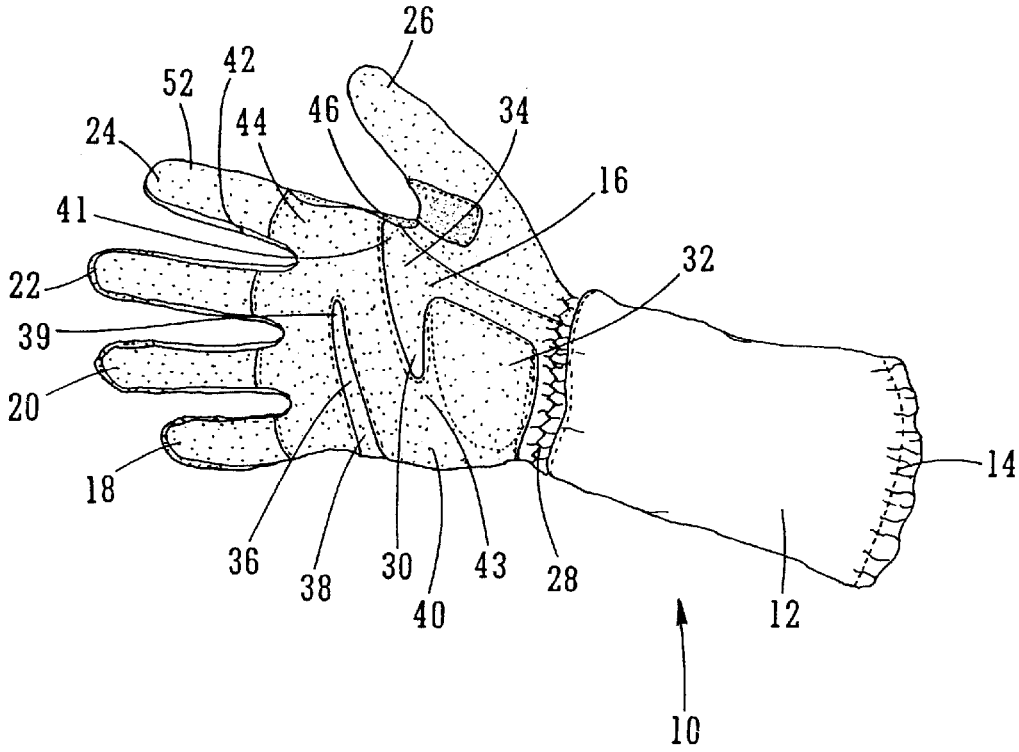
FIG. 4 is a perspective view of a glove according to this invention viewing the front, or palm side, of the glove.

A second cut out 34 is optionally, and preferably, disposed in the palm portion 30 of the glove body 16. In a preferred embodiment, this cut out is in the general shape of a slanted "T". The length direction of the "T" is disposed between the pad 32 and the base of the thumb member 26. The arms of the "T" are disposed between the pad 32 and the base of the thumb member 26, respectively, and the main section of the palm portion of the glove body 40. As shown in FIG. 4, the cross bar of the "T" extends from a point 41 proximate to the based of the index finger 24 to a point 43 proximate to the base of the ring finger 20. The length of this cross bar can be varied, however, it has been found that extending it as depicted presents a nice compromise between restricting bunching up of glove body material and maintaining a sure high friction grip on the weapon.

An important feature that is shown in the drawing is that, for best results, the palm facing portions of the finger and thumb elements 18, 20, 22, 24 and 26, respectively, are constructed of high friction embossed leather or the like. Note that in this construction, substantially only the high friction leather touches the weapon (it is possible that a small fraction of the first layer of material may protrude through the first and second cut areas 36 and 34 and contact the weapon).

In order to further insure a good close fit between the hand/glove combination and the weapon stock, an additional piece of high friction leather or the like 46 is disposed in the well between the thumb 26 and the trigger finger 24 elements. Lastly, an additional piece of high friction material can be disposed over the outside of the thumb element 26 so that, when the weapon is properly held by the operator, this last piece of leather sits on top of the thumb in general line of sight with the weapon's sights 48 and 50.

As has been noted, it has been common for shooters to remove the fingertip portion 52 of the trigger finger element 24. This has, in the past been done by simply cutting the fingertip portion of the glove off. This caused unraveling of the portion of the glove material that was made from a knitted fabric and was proximate to the cut. In order to correct this situation, the instant glove preferably has a cut ring 42 disposed in at least the fabric portion of the index finger element 24. The knitted fabric that makes up the portion of the glove covering the trigger fingertip is isolated from the fabric that covers the remainder of the trigger finger so that if the finger covering fabric material is cut along the cut ring 42, the fingertip portion will be easily removable and the remaining fabric will not unravel.

While the specific polymer, that is used for making the filaments or yarns that are knitted into the fabric used in the glove of this invention, is not limiting on the scope of this invention, it is preferred to use high molecular weight aramid polymers, such as those sold under the Kevlar name, for this purpose. High molecular weight polyolefins, such as polyethylene, are well known antiballistic materials that are available in fibrous form. These fabrics are sold commercially under the names "Spectra®", and "Protera®", respectively. Another of the newer anti-ballistic filaments is poly (1,4-phenylene-2,6-benzobisoxazole) resin, that is sometimes referred to as PBO. In fact, there are many anti-ballistic materials that are well known and widely published that have anti-ballistic capability. Any of these are useful in making the glove of this invention.

Specific reference is made to U.S. Pat. No. 4,681,792, that describes different polymer filaments that are useful in anti-ballistic fabrics. The entire contents of this patent are hereby incorporated herein by reference for the purpose of disclosing many polymeric materials that have been indicated to be useful in anti-ballistic fabrics.

It is within the scope of this invention to provide a pair of gloves that, between them, have but one finger element with a cut line. It is also within the scope of this invention to provide a pair of gloves with a plurality of cut lines associated with a plurality of finger elements.

Figure 5:
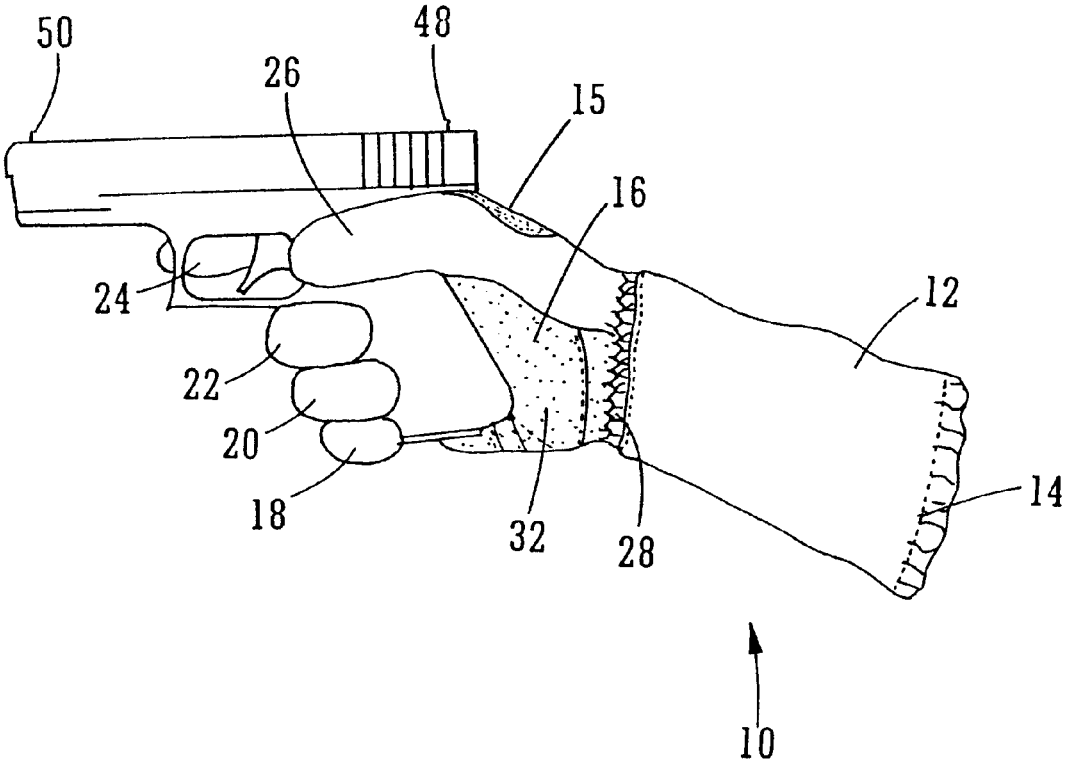
FIG. 5 is a perspective view of a glove according to this invention with an operator's hand therein and showing the position of the glove when holding a weapon.
Figure 6:
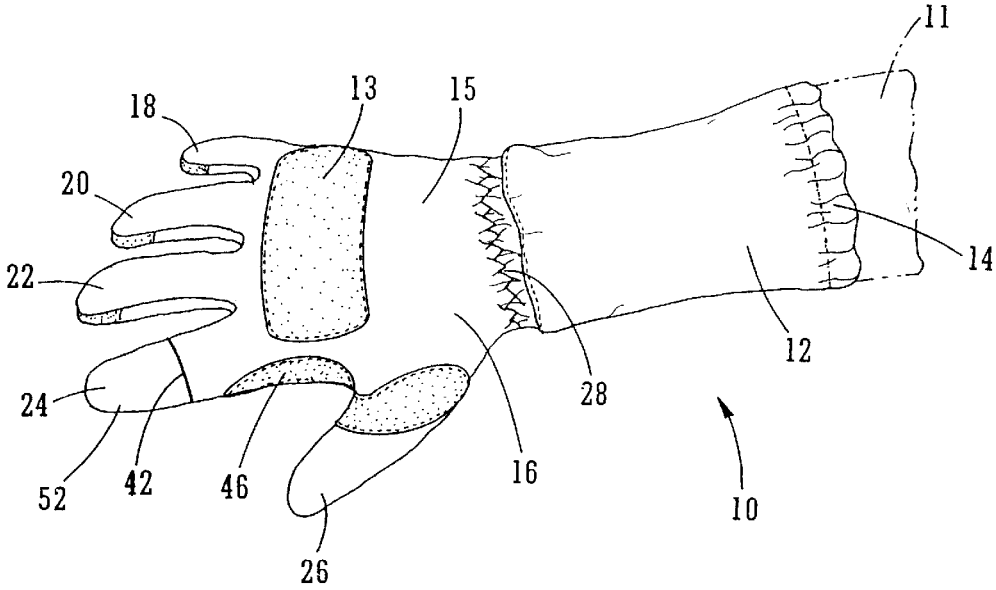
FIG. 6 is a perspective view of a pair of gloves according to this invention.
Figure 6:
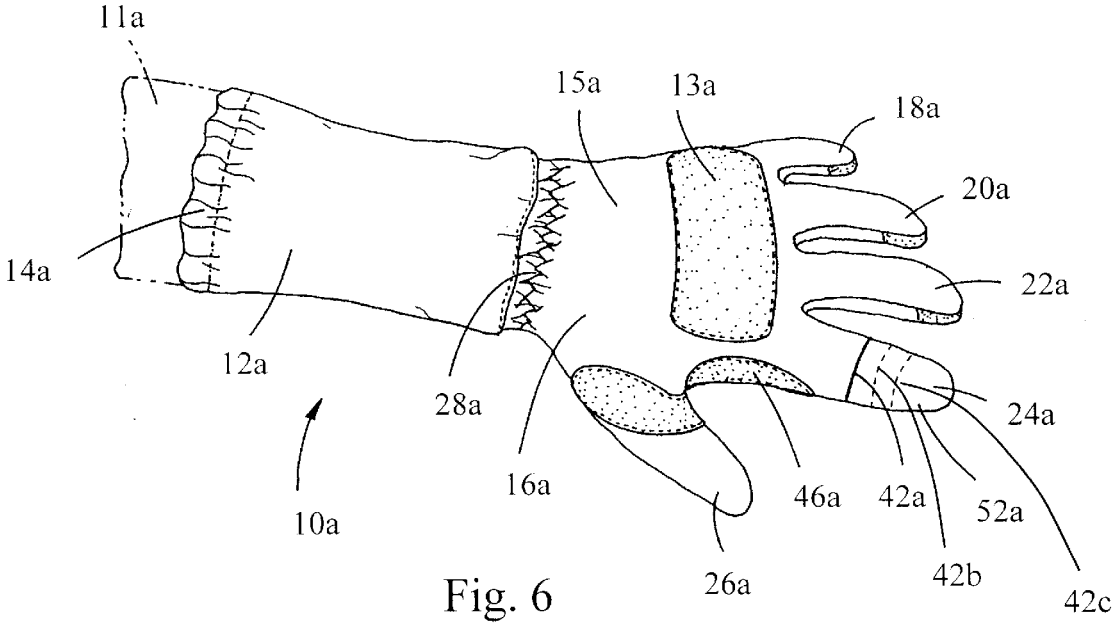

Referring now to FIG. 6, there is shown a pair (left and right handed) of gloves according to this invention. Note that the right hand glove is identical to the glove depicted in FIG. 5, while the depicted left hand glove is a mirror image of the right hand glove with the exception that the left hand glove has three (3) spaced apart cut lines in its index finger element. Most of the reference numerals in the left hand glove of FIG. 6 are the same as the reference numerals applied to the right hand glove in that figure except that the left hand glove reference numerals that are the same as the reference numerals of the right hand glove have an "a" after each one. Further, there are additional reference numerals; 42,*b* and 42*c* showing plural cut lines that are preferably cross stitched.

What is claimed is:

1. A glove comprising:

a main body portion; comprising a palm portion, that closely approximates the size and shape of at least a portion of a hand; and at least one finger element that extends from the main body portion;

wherein at least one of said finger elements comprises at least a portion of a woven and/or knitted textile material that is subject to unraveling when cut; wherein said textile material is interrupted by at least one cut ring disposed about at least a portion of a finger element that is disposed between a wearer's palm and a distal end of said finger element; said cut ring being disposed in operative relationship with at least said textile portion of said finger element such that it is adapted to substantially prevent unraveling of textile fabric disposed on a proximal side of said cut ring as a consequence of cutting textile fabric in said cut ring or on a distal side of said cut ring.

2. A glove as claimed in claim 1 further comprising a gauntlet that extends away from the main body portion and is adapted to cover at least a portion of a fore arm of a wearer of the glove.

3. A glove as claimed in claim 2 further comprising a first elastic member disposed proximate to the juncture of said gauntlet and said main body portion and positioned so that the first elastic member is adapted to be proximate to a wrist of the wearer.

4. A glove as claimed in claim 2 further comprising a second elastic member disposed proximate to an end of said gauntlet that is directed away from said body portion.

5. A glove as claimed in claim 1 wherein said palm directed portion comprises:

at least one first portion that comprises at least a first sheet material that is adapted to be directed toward the palm of the wearer and at least one second sheet material overlying a portion of said first sheet material that is adapted to be directed away from the palm of a wearer; and a second portion that comprises fewer overlying sheet materials than said first portion.

6. A glove as claimed in claim 5 wherein said second portion is sized and shaped such that when said glove is closed into a fist-like shape, said first sheet material does not substantially bunch up.

7. A glove as claimed in claim 1 wherein said main body portion comprises a front portion that is adapted to be proximate to a palm of the wearer, and a back portion that is adapted to be proximate to a back of a wearer's hand.

8. A glove as claimed in claim 1 comprising a plurality of finger elements.

9. A glove as claimed in claim 1 comprising anti-ballistic fabric.

10. A glove as claimed in claim 9 further comprising material adapted to be in contact with a weapon, that has a higher coefficient of friction with respect to material of said weapon than the coefficient of friction of said anti-ballistic material with said weapon.

11. A glove as claimed in claim 1 further comprising a pad attached to a back of said glove and adapted to be proximate to a location of knuckles of a wearer of said glove.

12. A glove as claimed in claim 1 wherein said finger portion comprises a trigger finger portion.

13. A glove as claimed in claim 12 wherein said trigger finger element comprises a knitted fabric.

14. A glove as claimed in claim 13 wherein said cut line comprises cross stitch elements adapted to separate the weave of the distal portion of said trigger finger element from the weave of the proximal portion of the trigger finger element.

15. A glove as claimed in claim 1 having one cut line.

16. A glove as claimed in claim 1 further comprising an encircling elastic element disposed proximate to the proximal end of the glove where it is adapted to be disposed about and proximate to the wrist of a wearer.

17. A glove as claimed in claim 3 wherein said elastic element is disposed about the circumference of said glove at about the juncture of the base of the thumb and the gauntlet, and wherein said elastic element is of sufficiently small diameter as to be adapted to require a glove wearer to expand said elastic element while pulling said glove onto the hand, and wherein after said glove is disposed over said hand, said elastic element is adapted to maintain the glove on the hand.

18. A pair of gloves, comprising at least one glove as claimed in claim 1, having one cut line between both gloves.

19. A pair of gloves, comprising at least one glove as claimed in claim 1, having a plurality of cut lines associated with a plurality of finger elements.

20. A glove as claimed in claim 1 having a plurality of said cut lines.

* * * * *